US007777162B2

(12) United States Patent
Park

(10) Patent No.: US 7,777,162 B2
(45) Date of Patent: Aug. 17, 2010

(54) CONNECTOR AND HEATER THAT EQUIP THIS FOR CLOSENESS OF A HEATING PIPE

(76) Inventor: Cheol-Woo Park, 103-1602 Chonggu Apt., Dongseo-ri, Hayang-eup, Gyeongsan-si, Gyeongsangbuk-do (KR) 712-908

( * ) Notice: Subject to any disclaimer, the term of this patent is extended or adjusted under 35 U.S.C. 154(b) by 573 days.

(21) Appl. No.: 11/815,070

(22) PCT Filed: Jul. 3, 2006

(86) PCT No.: PCT/KR2006/002600

§ 371 (c)(1),
(2), (4) Date: Jul. 30, 2007

(87) PCT Pub. No.: WO2007/004841

PCT Pub. Date: Jan. 11, 2007

(65) Prior Publication Data

US 2008/0011739 A1 Jan. 17, 2008

(30) Foreign Application Priority Data

Jul. 1, 2005 (KR) ..... 10-2005-0059132
Jul. 1, 2005 (KR) ..... 20-2005-0019166 U

(51) Int. Cl.
*H05B 3/58* (2006.01)
*H01R 13/52* (2006.01)

(52) U.S. Cl. ..... 219/535; 219/536; 219/540; 219/541; 439/277; 439/291

(58) Field of Classification Search ..... 219/536–7, 219/541; 439/277, 291
See application file for complete search history.

(56) References Cited

FOREIGN PATENT DOCUMENTS

| | | | |
|---|---|---|---|
| KR | 20-1999-004774 | U | 2/1999 |
| KR | 10-2002-0013226 | A | 4/2002 |
| KR | 10-2002-0028989 | A | 4/2002 |
| KR | 20-0274853 | Y1 | 4/2002 |
| KR | 20-0274853 | Y1 | 5/2002 |
| KR | 20-0276023 | Y1 | 5/2002 |
| KR | 20-0276023 | Y1 | 6/2002 |

*Primary Examiner*—Shawntina Fuqua
(74) *Attorney, Agent, or Firm*—IPLA P.A.; James E. Bame

(57) ABSTRACT

A connector closing a heating pipe and a heating apparatus having the connector are disclosed. The connector of the present invention includes a plug unit (110), which conductive members (112) and a plug body part (111), and a socket unit (120), which includes a socket body part (121), having through holes (121*a*) therein, and second conductive members (122) provided in the socket body part (121). The connector further includes a coupling nut (130) and a coupling screw (140), which connect the plug unit and the socket unit to each other. In the connector having the above-mentioned construction and the heating apparatus having the connector, heating wires and electric wires are securely separated from each other, thus preventing shorts from occurring. Furthermore, a tapered part is formed on the circumferential inner surface of the coupling nut. Thus, when the coupling nut, a radiating pipe (11) and a socket unit are assembled together, the radiating pipe is reliably sealed.

12 Claims, 8 Drawing Sheets

[Fig. 1]
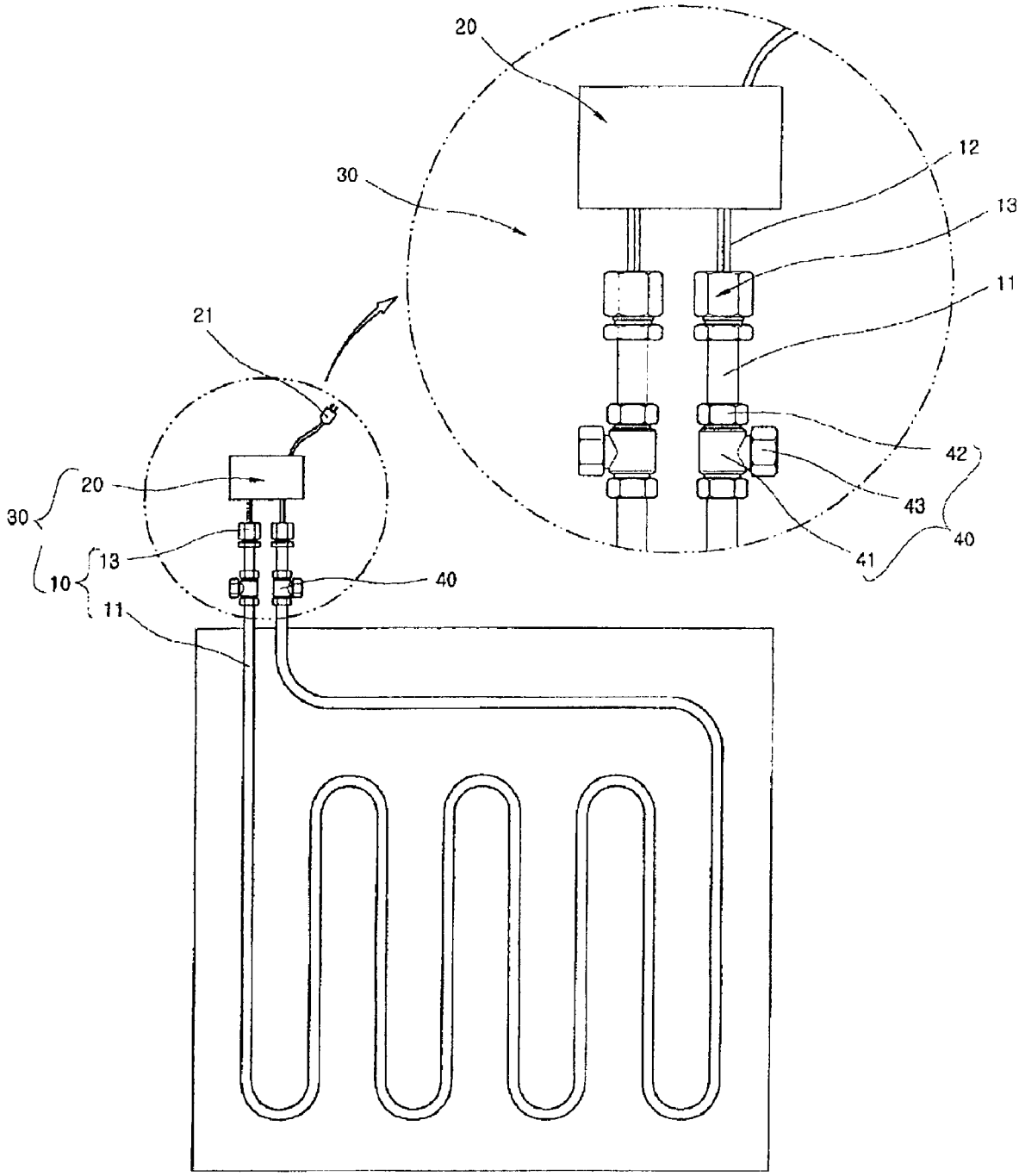

[Fig. 2]
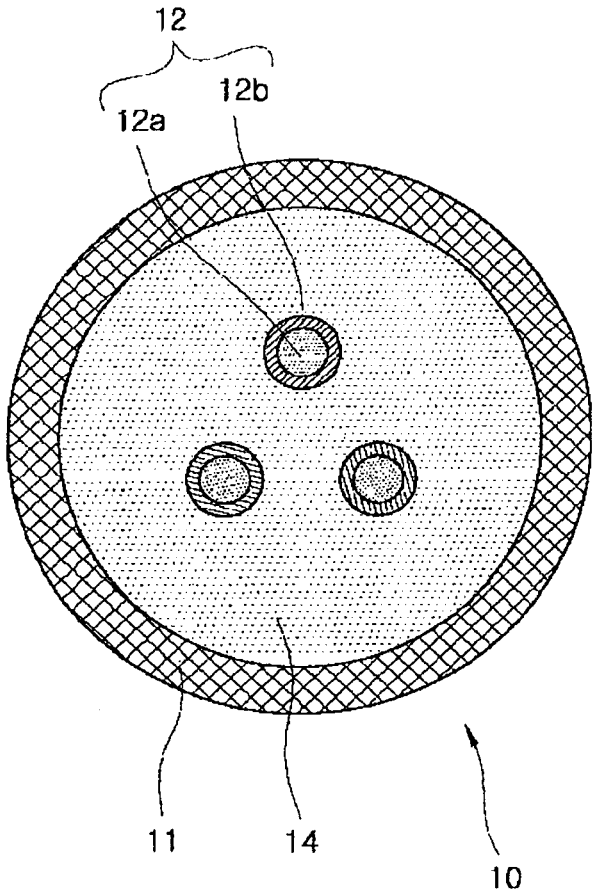
[Fig. 3]
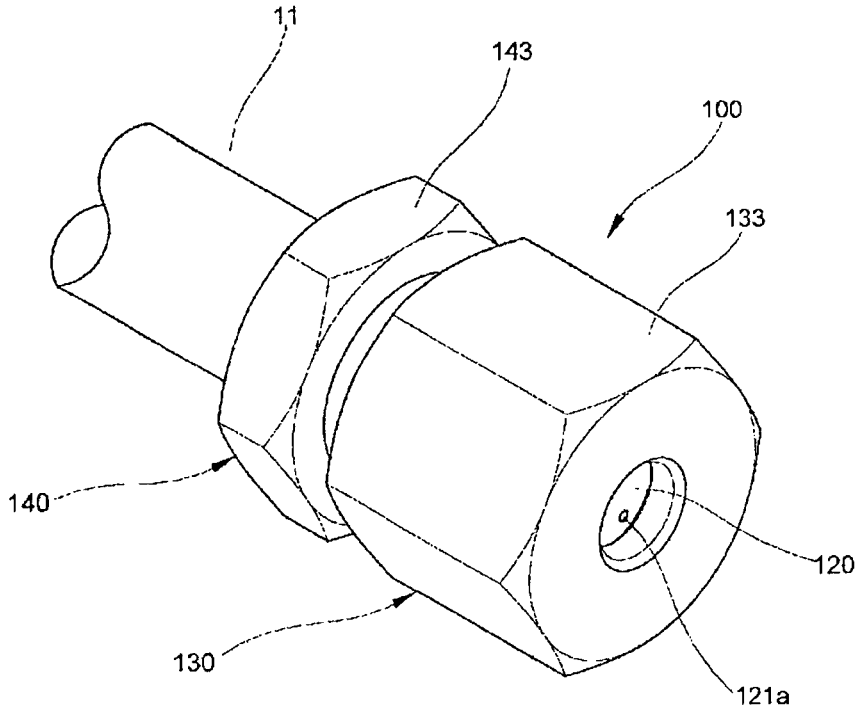

[Fig. 4]
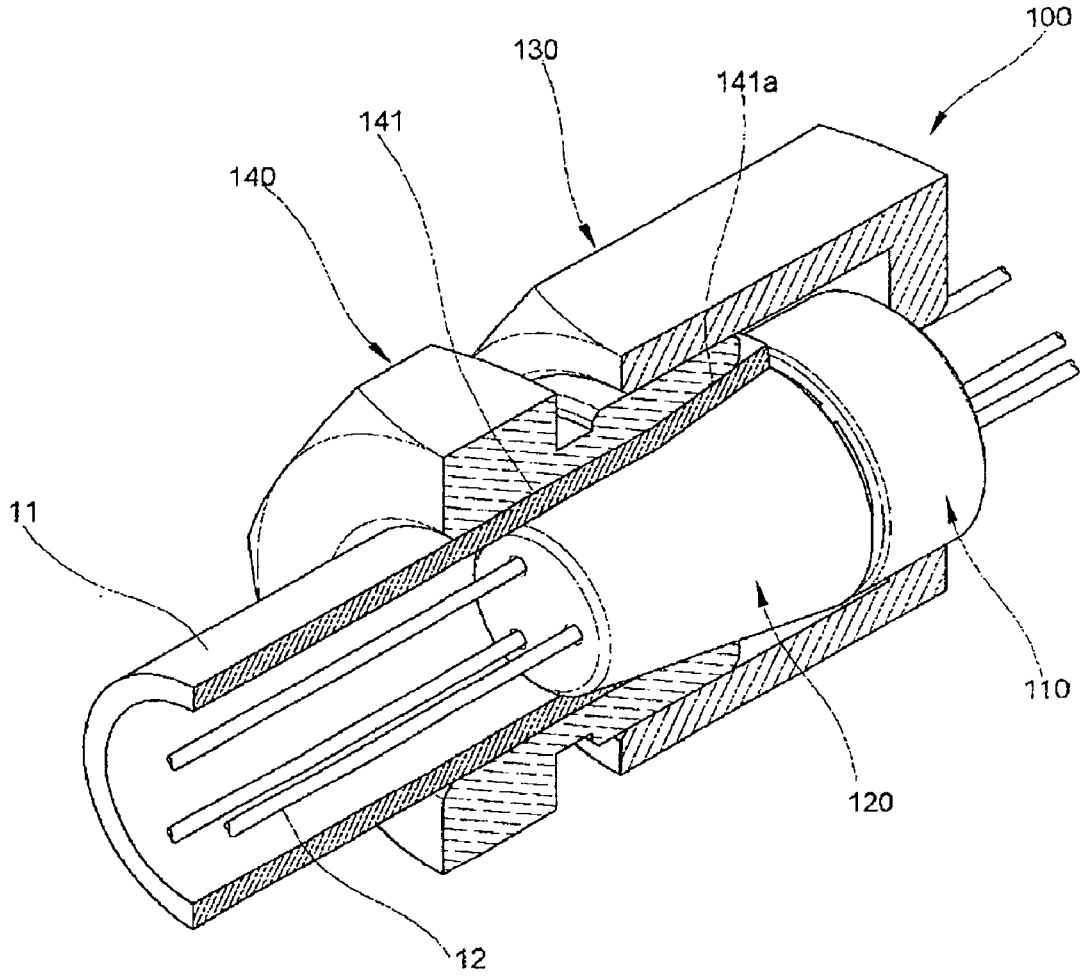

[Fig. 5]
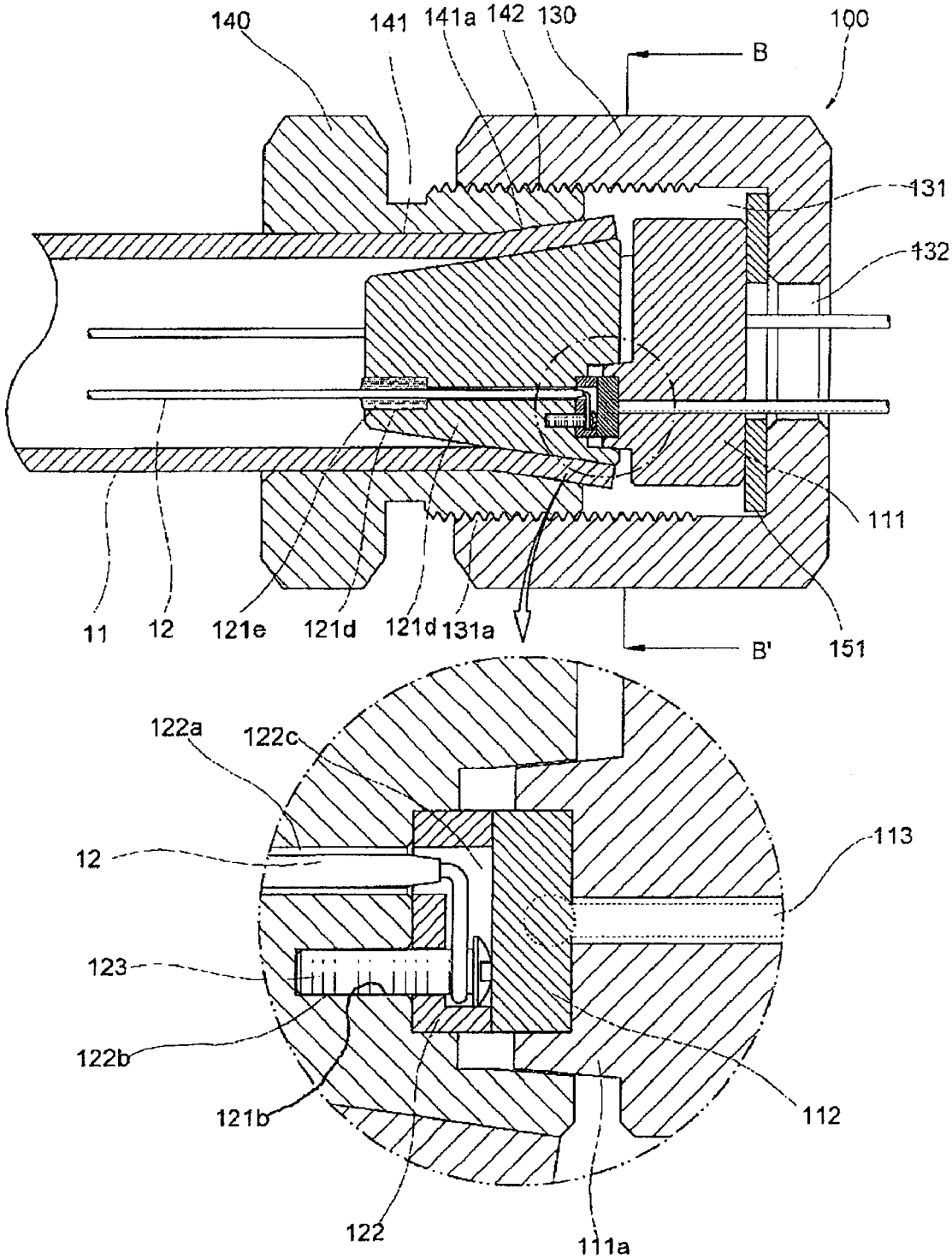

[Fig. 6]
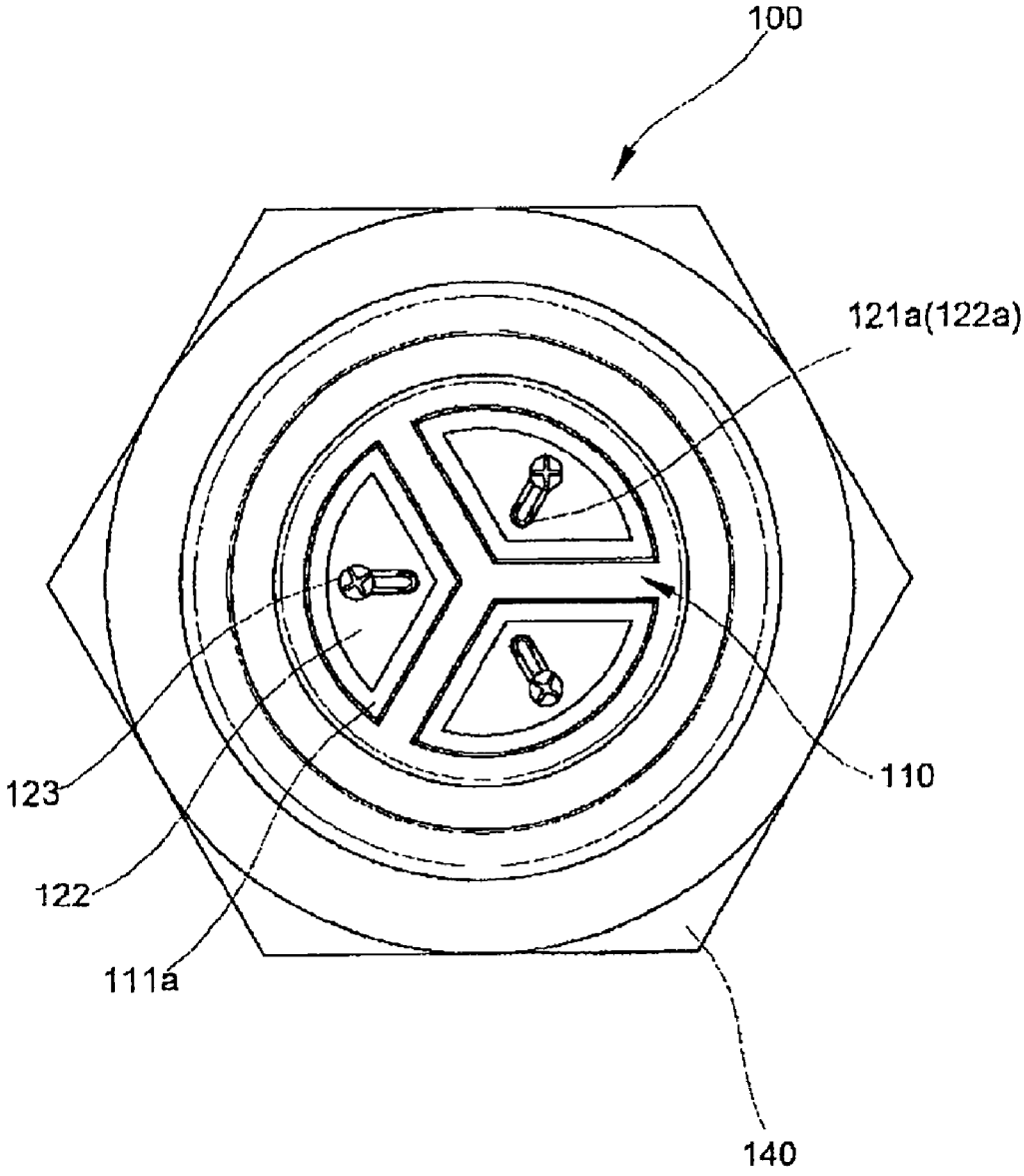

[Fig. 7]
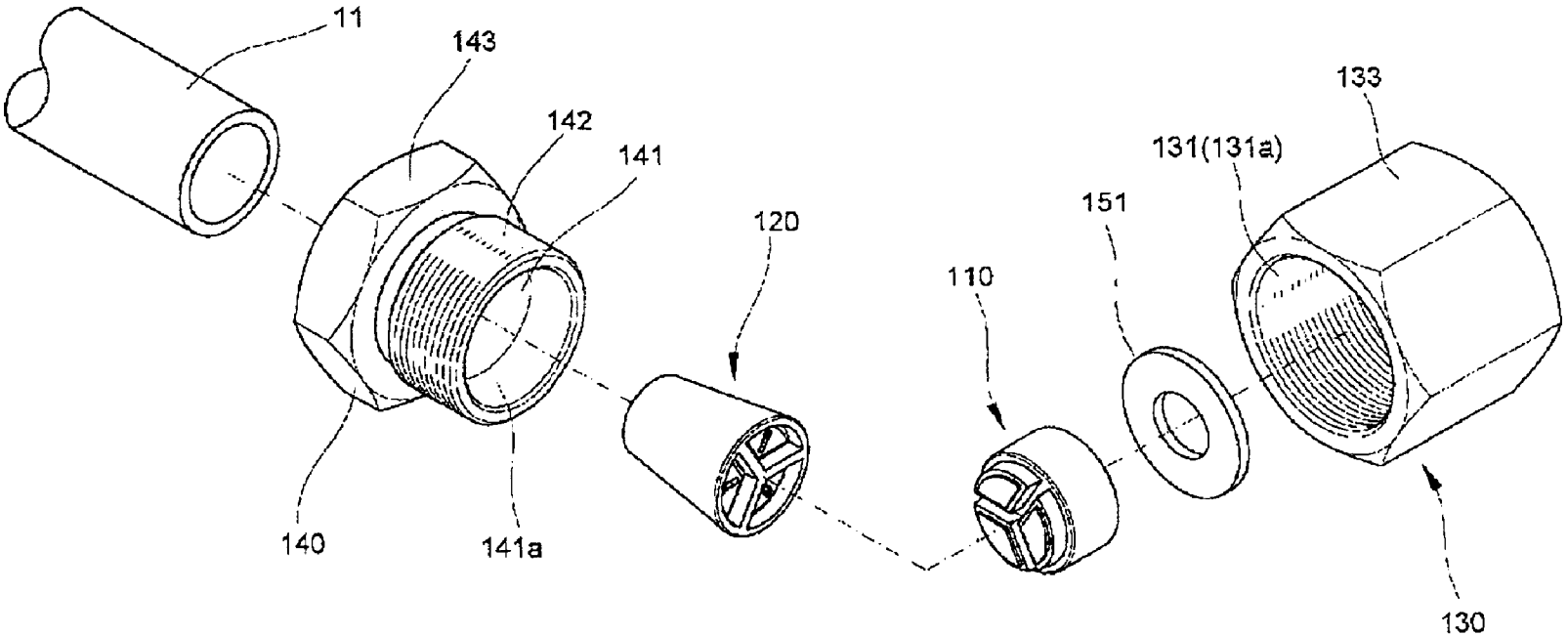

[Fig. 8]
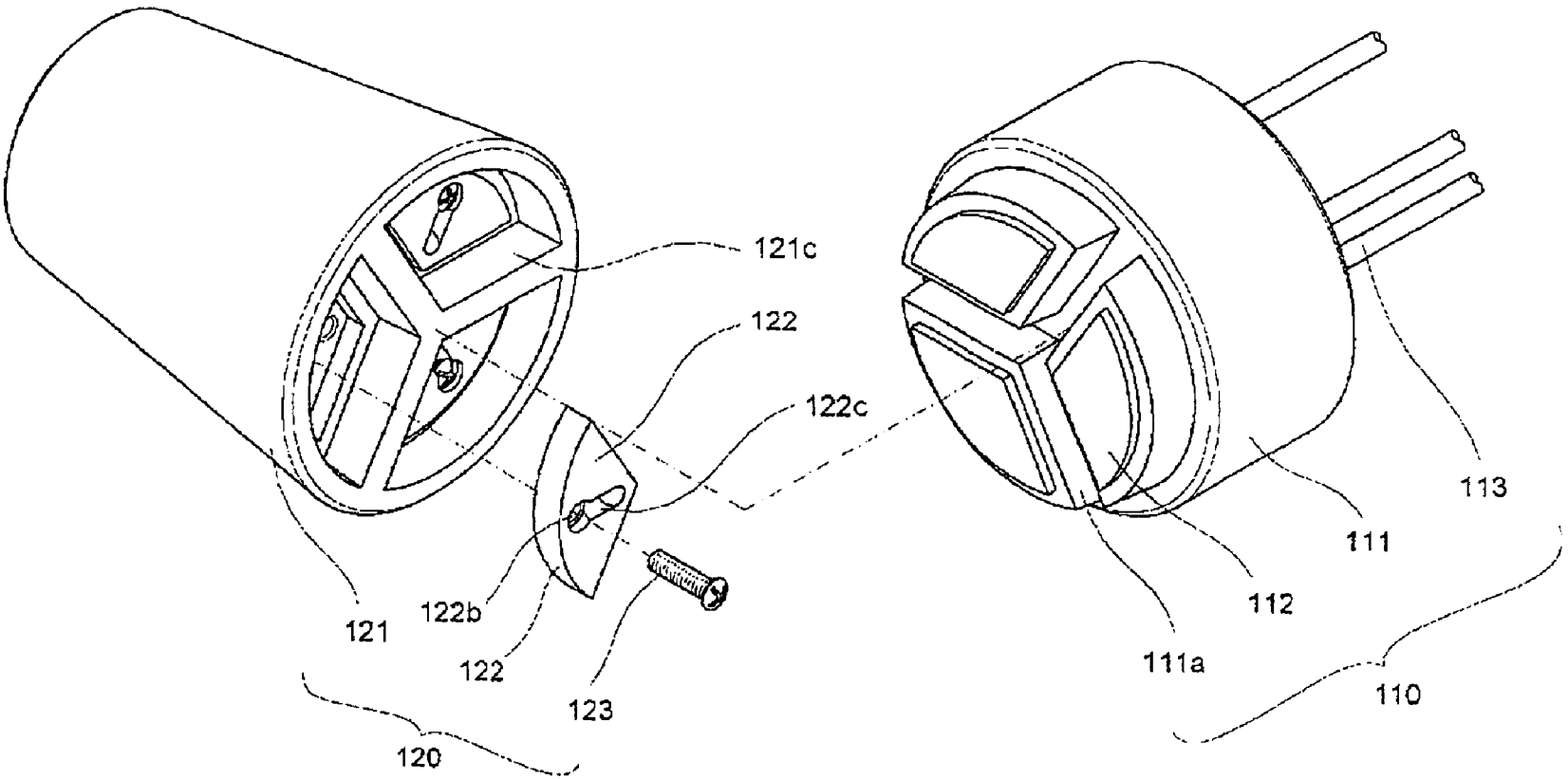

[Fig. 9]
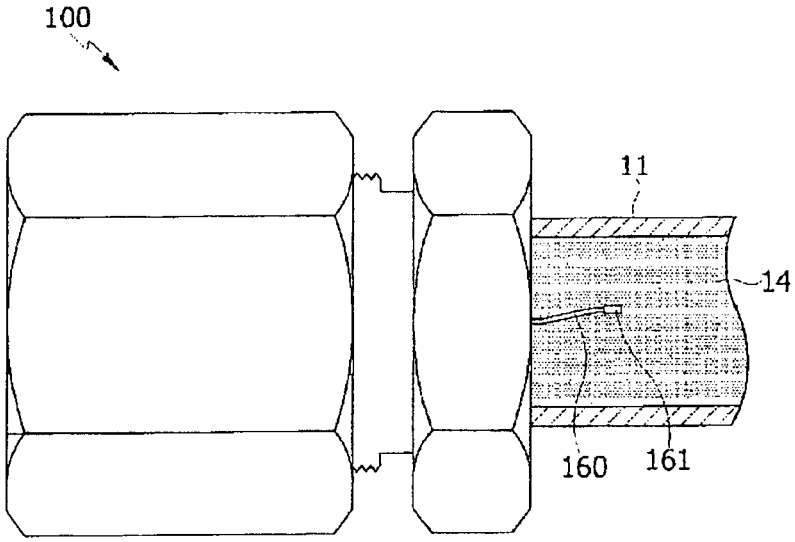
[Fig. 10]
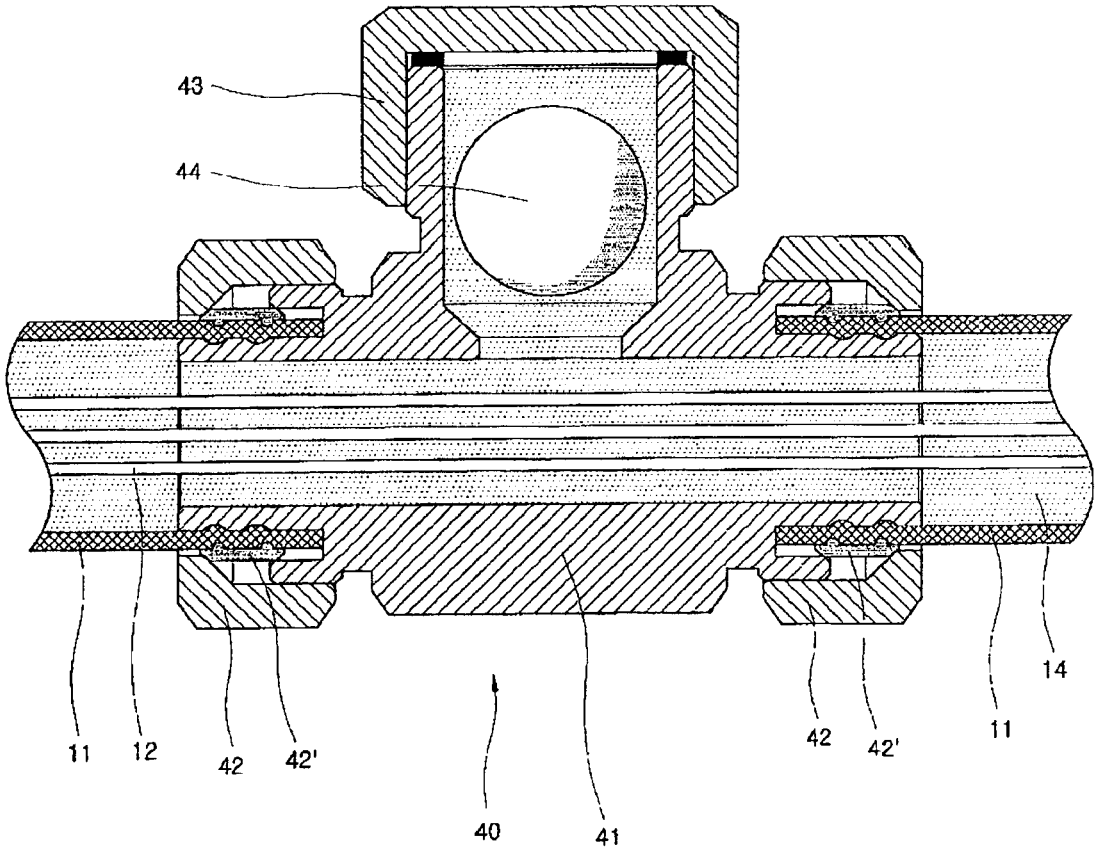

CONNECTOR AND HEATER THAT EQUIP THIS FOR CLOSENESS OF A HEATING PIPE

CROSS REFERENCE TO RELATED APPLICATION

This application is a 35 USC §371 National Phase Entry Application from PCT/KR2006/002600 filed Jul. 3, 2006 and designating the United States. This application claims priority under 35 U.S.C. §119 based on Korean Patent Application Nos. 20-2005-0019166 filed Jul. 1, 2005 and 10-2005-0059132 filed Jul. 1, 2005, which are incorporated herein in their entirety.

TECHNICAL FIELD

The present invention relates, in general, to connectors for closing heating pipes and heating apparatuses having the connectors and, more particularly, to a connector, which includes a plug unit, in which a plurality of first conductive members connected to electric wires is provided in a conical plug body part and the first conductive members and the electric wires protrude outside the respective opposite surfaces of the plug body part, a socket unit, in which through holes are longitudinally formed through a conical socket body part and second conductive members are provided in the through holes using screws, and a coupling nut and a coupling screw coupling the plug unit and the socket unit to each other, so that the connector reliably closes each end of a heating pipe in a state in which heating wires provided in the heating pipe are connected to the electric wires, and to a heating apparatus, which includes: the heating pipe that has a radiating pipe, through which at least three strands of heating wires are provided, and liquid heating medium charged in the radiating pipe; and a control unit to control the operation of the heating pipe, so that, when a heating operation is started under the control of the control unit, electricity is supplied to the all heating wires to rapidly increase the temperature of the liquid heating medium, and supply and interruption of electricity to and from each heating wire can be independently controlled by the control unit, thus efficiently controlling the temperature of the liquid heating medium.

BACKGROUND ART

As well known to those in the art, in heating systems using boilers which have been generally used, hot water, which is heated by combustion of oil or gas used as a heat source, circulates through a radiating pipe, thus heating a desired place. To construct such a heating system, an insulation layer is formed on a planar support surface, and a heat storage layer, which comprises gravel and coarse sand, is thereafter formed on the insulation layer. Subsequently, a radiating pipe, which comprises a metal pipe or a synthetic resin pipe having superior heat conductivity, is evenly arranged on the insulation layer. The radiating pipe is covered with and finished by mortar. Thus, heating operation is realized by hot water circulating the radiating pipe. However, in the conventional heating system using the boiler, there is a problem of noise due to circulation of water. Furthermore, due to existence of the boiler and a fuel tank for containing oil, a large installation space is required. In the case that gas is used as fuel, due to the hazardous nature of the gas, there is an inconvenience in that periodic maintenance and regular monitoring is required.

To solve the above-mentioned problems, heating apparatuses, which have a special cover that securely closes a heating pipe charged with liquid heating medium and guides a heating wire, which is prevented from being directly exposed to the heating medium liquid, were proposed in Korean Utility Model Registration No. 326738 and Korean Utility Model Registration No. 331132. However, in these apparatuses, only a single strand of heating wire is placed through the radiating pipe, and the cover serves merely to close the radiating pipe and to guide the heating wire. Therefore, there are problems of fire hazard and of heat loss due to the heating wire being exposed to the outside. Furthermore, even if several strands of heating wires are provided, because the heating wires may be incorrectly connected to outside electric wires, there is a possibility of shorting. That is, there is a problem in that the operation of the prior art heating apparatus is unsafe.

DISCLOSURE OF INVENTION

Technical Problem

Accordingly, the present invention has been made keeping in mind the above problems occurring in the prior art, and an object of the present invention is to provide a heating apparatus which has a simple structure compared to that of the conventional art, so that installation and use thereof are convenient, and which includes a safety means, thus preventing a radiating pipe from being damaged, and preventing liquid heating medium from leaking to the outside.

Another object of the present invention is to provide a connector, which reliably seals a heating pipe, and in which a plug unit and a socket unit are connected to each other through first and second conductive members, which are respectively provided in the plug unit and the socket unit, to connect heating wires, placed in the heating pipe, to outside electric wires.

Advantageous Effects

In an aspect, the present invention provides a connector for heating apparatuses, including: a plug unit (110), comprising a plurality of first conductive members (112), each of which has a predetermined shape and is connected to an electric wire (113), and a plug body part (111), in which the first conductive members (112) are integrally inserted; a socket unit (120), comprising a socket body part (121) having a plurality of through holes (121*a*) therein, and a plurality of second conductive members (122) provided in the socket body part (121); a coupling nut (130), with a seating hole (131), having a predetermined depth, formed in the coupling nut (130), an internal thread (131*a*) formed on a circumferential inner surface of the seating hole (131), and a through hole (132) formed through a central portion of a bottom of the coupling nut (130); and a coupling screw (140), with an insertion hole (141) longitudinally formed through a central portion of the coupling screw (140), and an external thread (142) formed on a circumferential outer surface of an end of the coupling screw (140).

In another aspect, the present invention provides a heating apparatus using a heating pipe, through which heating wires are provided, including: the heating pipe (10), comprising a radiating pipe (11) made of a heat conductive pipe, the heating wire (12) provided through the radiating pipe (11), each of the heating wires (12) having a heating wire core (12*a*) and a covering (12*b*) surrounding an outer surface of the heating wire core (12*a*), liquid heating medium (14) charged into the radiating pipe (11), a temperature sensing wire (160) connected to a temperature sensor (161) to detect a temperature of the liquid heating medium, and a connector (100) closing each of the opposite ends of the radiating pipe (11); a control unit (20) to control supply and interruption of electricity using a temperature signal transmitted from the temperature sensor (161); and a safety means (40) comprising a T-shaped connection pipe (41) provided at a predetermined position in the radiating pipe, with an elastic ball (44) provided in the connection pipe (41) having a thread on each of opposite ends thereof, so that contraction of the elastic ball (44) prevents the radiating pipe (11) from bursting.

BRIEF DESCRIPTION OF THE DRAWINGS

FIG. 1 is a plan view and a partially enlarged view of a heating apparatus according to the present invention;

FIG. 2 is a sectional view taken along the line AA' of FIG. 1;

FIG. 3 is a perspective view of a connector provided in the heating apparatus according to the present invention;

FIG. 4 is a partially broken perspective view of the connector of the heating apparatus according to the present invention;

FIG. 5 is a sectional view and a partially enlarged view of the connector of the heating apparatus according to the present invention;

FIG. 6 is a sectional view taken along the line BB' of FIG. 3;

FIG. 7 is an exploded perspective view of the connector of the heating apparatus according to the present invention;

FIG. 8 is an exploded perspective view showing a plug and a socket of the connector of the heating apparatus according to the present invention;

FIG. 9 is a sectional view showing a temperature sensor provided in the connector of the present invention; and FIG. 10 is a sectional view showing an installation of a safety means according to the present invention.

DESCRIPTION OF THE ELEMENTS IN THE DRAWINGS

10: heating pipe 11: radiating pipe
12: heating wire 20: control unit
30: heating apparatus 40: safety means
100: connector 110: plug unit
112, 122: conductive member 120: socket unit
130: coupling nut 140: coupling screw

BEST MODE FOR CARRYING OUT THE INVENTION

Hereinafter, a preferred embodiment of the present invention will be described in detail with reference to the attached drawings such that those skilled in the art can easily appreciate the present invention.

FIG. 1 is a plan view and a partially enlarged view of a heating apparatus according to the present invention. FIG. 2 is a sectional view taken along the line AA' of FIG. 1. FIG. 3 is a perspective view of a connector provided in the heating apparatus according to the present invention. FIG. 4 is a partially broken perspective view of the connector of the heating apparatus according to the present invention. FIG. 5 is a sectional view and a partially enlarged view of the connector of the heating apparatus according to the present invention. FIG. 6 is a sectional view taken along the line BB' of FIG. 3. FIG. 7 is an exploded perspective view of the connector of the heating apparatus according to the present invention. FIG. 8 is an exploded perspective view showing a plug and a socket of the connector of the heating apparatus according to the present invention. FIG. 9 is a sectional view showing a temperature sensor provided in the connector of the present invention. FIG. 10 is a sectional view showing an installation of a safety means according to the present invention.

As shown in FIGS. 1 and 2, the heating apparatus 30 of the present invention includes the heating pipe 10, which has a radiating pipe 11, heating wires 12 and connectors 100 and is charged with a liquid heating medium 14.

In detail, the radiating pipe 11 serves to heat the bottom of a room, in the same manner as that of the conventional art. For example, a copper pipe, a steel pipe or a stainless steel pipe may be used as the radiating pipe 11. Alternatively, a synthetic resin pipe, having superior heat resistance, for example, an XL pipe, a PB pipe, etc., may be used as the radiating pipe 11. The radiating pipe 11 may have a uniform circular cross-section throughout the overall length thereof, or, alternatively, may be corrugated to increase the outer surface area thereof for ensuring increased heat transfer efficiency.

As shown in FIG. 2, each heating wire 12 includes a heating wire core 12*a* and a covering 12*b*, which covers the heating wire core 12*a*. When electricity is applied to the heating wire core 12*a*, the heating wire core 12*a* generates heat due to the internal resistance to a flow of electric current. The covering 12*b* has an insulation function and serves to prevent moisture and oxygen from penetrating the heating wire 12. For reference, a nichrome wire (Ni—Cr based alloy), which is an alloy of nickel and chrome, an iron-chrome wire (Fe—Cr based alloy), which is an alloy of iron and chrome, or a copper wire is preferably used as the heating wire core 12*a*. The temperature at which the heating wire core 12*a* generates heat may be adjusted by changing the thickness of the heating wire core 12*a* or by adjusting an amount of electric current. In the case of the nichrome wire, which is mainly used, the maximum allowable temperature thereof is an about 1000° C. Furthermore, the nichrome wire may have various thicknesses ranging from 0.05 mm to 12 mm, and the nichrome wire has superior oxidation resistance and superior gas resistance.

Furthermore, the covering 12*b* provides electric insulation and serves to exclude moisture and oxygen. That is, the covering 12*b* insulates electricity to prevent shorting and further prevents corrosion and oxidation. The covering 12*b* is formed by applying silicone on the outer surface of the heating wire core 12*a* or by surrounding a synthetic resin tape, having superior heat resistance and superior insulation ability, around the heating wire core 12*a*. The heating wire 12, which is manufactured by forming the covering 12*b* on the heating wire core 12*a*, as described above, comprises three to five strands of heating wires 12. The several heating wires 12 are constructed such that they are placed through the heating pipe 11. Even when the radiating pipe 11 is relatively long, it is preferable that the heating wires 12 be fixed at positions, spaced apart from each other by predetermined distances, by tying them using covering tapes having superior heat resistance.

As shown in FIGS. 3 through 9, the connector 100 according to the present invention includes a plug unit 110, a socket unit 120, a coupling nut 130 and a coupling screw 140.

The plug unit 110 includes a plug body part 111, first conductive members 112 and electric wires 113, which are assembled into a single body. The plug body part 111 is made of dielectric material and has a cylindrical shape. Several protrusions 111*a*, which have predetermined shapes and predetermined heights, are provided in a first end of the plug body part 111 at regular angular intervals. Each first conductive member 112 is made of metal having superior conductivity and has a predetermined thickness. That is, the plug unit 110 has a structure such that the several first conductive members 112, each of which are connected at a surface thereof to each electric wire 113 by soldering or the like, are integrally inserted in the first end of the plug body part 111 in a longitudinal direction of the plug body part 111. Furthermore, each first conductive member 112 protrudes from each protrusion 111*a*, and the electric wires 113, which are connected to the respective first conductive members 112, extend outside a second end of the plug body part 111.

The socket unit 120 includes a socket body part 121, second conductive members 122 and screws 123. The socket body part 121 is made of dielectric material and has a conical shape, which is reduced in diameter from a first end thereof to a second end thereof. Furthermore, seating depressions 121*c*, each of which has a predetermined shape and a predetermined depth, are formed in the first end of the socket body part 121 which is the end having a larger diameter. Because the protrusions 111*a* of the plug unit 110 are inserted into the respective seating depressions 121*c* of the socket unit 120, the positions and number of seating depressions 121*c* must correspond to those of the protrusions 111*a*. In addition, a through hole 121*a* and an internal thread hole 121*b* are formed in each seating depression 121*c*. The through hole 121*a* is formed through the socket body part 121 in a longitudinal direction of the socket body part 121. That is, the several through holes 121*a* are spaced apart from each other at regular angular intervals. Each internal thread 121 is formed in a hole, which is formed around each through hole 121*a*.

Each second conductive member 122 is made of metal, such as copper, having superior conductivity, and has the same shape as that of the seating depression 121*c*. As well, the second conductive member 122 is slightly smaller than that of the seating depression 121*a* and has a thickness less than the depth of the seating depression 121*c*. Furthermore, two through holes 122*a* and 122*b*, which are spaced apart from each other by a predetermined distance, are formed through each second conductive member 122. A guide groove 122*c*, having a predetermined depth, is formed between the two through holes 122*a* and 122*b*.

Each screw 123 is made of conductive material. The second conductive members 122 are seated into the respective seating depression 121*c* of the socket body part 121. Each screw 123 is inserted into the through hole 122*b* of each second conductive member 122 and engages with the associated internal thread hole 121*b* of the socket body part 121, thus constructing the socket unit 120.

Meanwhile, the protrusions 111*a*, which protrude from the plug unit 110, are inserted into the respective seating depressions 121*c* of the socket unit 120. Thereby, the first and second conductive members 112 and 122 come into contact with each other. This insertion structure, if required, may be constructed such that the plug unit 110 has a depressed structure while the socket unit 120 has a protruding structure, which is inserted into the depression of the plug unit 110.

The coupling nut 130 has a cylindrical shape, and a seating hole 131, which has a predetermined depth, is formed in the coupling nut 130. An internal thread 131*a* is formed in the circumferential inner surface of the seating hole 131. A through hole 132 is formed in the coupling nut 130 at a central position of the seating hole 131. A planar surface part 133, which facilitates the rotation of the coupling nut 130, is formed on the circumferential outer surface of the coupling nut 130. As shown in FIG. 7, the planar surface part 133 protrudes in a circumferential direction to have a similar shape to that of a typical nut or a bolt head. Furthermore, the coupling nut 130 is made of synthetic resin, which is dielectric and has superior heat resistance.

Meanwhile, the coupling screw 140 has a cylindrical shape. An insertion hole 141 is longitudinally formed through the coupling screw 140. A tapered part 141*a*, which is increased in the inner diameter from a first end of the coupling screw 140 to a second end, is formed on the circumferential inner surface of the insertion hole 141. The tapered part 141*b* has a shape corresponding to that of the conical socket body part 121 of the socket unit 120. Furthermore, an external thread 142 is formed on the circumferential outer surface of the second end of the coupling screw 140 which is adjacent to the tapered part 141*b*. A planar surface part 143 is provided on the first end of the coupling nut 140 to facilitate the rotation of the coupling nut 140. As shown in FIG. 7, the planar surface part 143 protrudes in a circumferential direction to have a similar shape to that of a typical nut or a bolt head. In addition, the coupling nut 140 is made of synthetic resin, which is dielectric and has superior heat resistance.

As such, each connector 100 is provided by assembling the plug unit 110, the socket unit 120, the coupling nut 130 and the coupling screw 140 together. For this, as shown in FIGS. 3 through 8, the protrusions 111*a* of the plug unit 110 are inserted into the respective seating depression 121*c* of the socket unit 120, so that the first and second conductive members 112 and 122 come into contact with each other. Thereafter, the socket unit 120 and the plug unit 110, which are coupled to each other, are inserted into the seating hole 131 of the coupling nut 130. The end of the socket unit 120 which is opposite to the plug unit 110 is inserted into the insertion hole 141 of the coupling screw 140, and the external thread 142 of the coupling screw 140 engages with the internal thread 131 a of the coupling nut 130, thus completing the connector 100.

Here, a method of coupling each connector 100 to each end of the radiating pipe 11 will be explained with reference to FIGS. 3 and 4. First, the connector 100 is dis-assembled by loosening the coupling nut 130 from the coupling screw 140. Thereafter, the coupling screw 140 is fitted over the end of the radiating pipe 11 to close the radiating pipe 11. The heating wires 12, which are disposed in the radiating pipe 11, are inserted into the through holes 121*a* of the socket unit 120 such that the heating wires 12 protrude into the seating depressions 121*c* of the socket unit 120. The ends of the heating wires 12 which protrude into the seating depressions 121*c* pass through the respective through holes 122*a* of the second conductive members 122. Thereafter, a covering is removed from the end of each heating wire 12, and the end of the heating wire 12 is fastened to the second conductive member 122 using the screw 123. Subsequently, the protrusions 111*a* of the plug unit 110 are inserted into the respective seating depressions 121*c* of the socket unit 120, and the coupling nut 130 is securely fitted over the coupling screw 140. Then, the interior of the radiating pipe 11 is reliably sealed.

Meanwhile, as shown in FIG. 5, the socket unit 120 is inserted into the radiating pipe 11. Here, when the coupling screw 140 and the coupling nut 130 are rotated in directions in which they are tightened, the circumferential outer surface of the radiating pipe 11 comes into close contact with the tapered part 141*a* of the coupling screw 140 while the outer surface of the socket unit 120 is forcibly fitted into the circumferential inner surface of the radiating pipe 11. Thus, the radiating pipe 11 can be reliably sealed.

Meanwhile, as shown by the enlarged view of FIG. 4, each protrusion 111*a* of the plug unit 110 is reduced in diameter from the proximal end thereof to the distal end thereof, so that the cross-section of the protrusion 111*a* forms an inclined surface. Each seating depression 121*c* of the socket unit 120, corresponding to the protrusion 111*a*, is reduced in diameter from the outer surface thereof to the interior thereof, so that the cross-section of the seating depression 121*c* forms an inclined surface. Therefore, each protrusion 111*a* can be easily fitted into the associated seating depression 121*c*. Furthermore, each through hole 121*a* of the socket unit 120 has a diameter such that the heating wire 12 forcibly passes through the through hole 121*a*. A sealing hole 121*d*, which has a predetermined depth and communicates with each through hole 121*a*, is formed in the socket unit 120 at a position opposite to the seating depression 121*c*. After the heating wire 12 passes through the through hole 121*a*, the sealing hole 121*d* is charged with sealing agent 121*e*, such as silicone, thus liquid heating medium 14, charged in the radiating pipe 11, is prevented from leaking through the through hole 121*a*.

Furthermore, as shown in FIG. 4, a washer 151 made of metal is provided on the bottom of the seating hole 131 of the coupling nut 130, thus preventing the coupling nut 130 and the plug unit 110, which are made of different material, from being worn.

As well, as shown in FIG. 9, at least one temperature sensing wire 160 is fastened to the connector 100, and a temperature sensor 161 is provided on an end of the temperature sensing wire 160 to detect the temperature of the interior of the radiating pipe 11 and to send the detected value to the outside. Preferably, the temperature sensor 161 is disposed in the radiating pipe 11 to measure the temperature of the liquid heating medium 14. As required, the temperature sensor 161 may be attached to the outer surface of the radiating pipe 11.

Liquid, having a high specific heat property, and having a boiling point that is not excessively low and a freezing point that is not excessively high, is used as the liquid heating medium 14. It is preferable that water having the above properties be used.

The structure of the heating pipe 10, which includes the radiating pipe 11, the heating wires 12, the connectors 100 and the liquid heating medium 14, will be explained herein below. Three or, as required, more strands of heating wires 12 are inserted into the radiating pipe 11, and the liquid heating medium 14 is charged into the radiating pipe 11. Subsequently, the connectors 100 are coupled to the respective opposite ends of the radiating pipe 11, which is charged with the liquid heating medium 14, thus sealing the radiating pipe 11. Furthermore, to reliably seal the radiating pipe 11 and thus to prevent liquid heating medium 14 from leaking, a Teflon tape is securely wound around each end of the radiating pipe 11.

Meanwhile, a preset temperature value is input in a control unit 20. The control unit 20 maintains the preset temperature of the radiating pipe 11 through a method of supplying or interrupting electricity to or from the heating wires 12 depending on the temperature of the liquid heating medium 14 detected by the temperature sensing wire 160. The control unit 20 is connected to the heating wires 12 and the temperature sensing wire 160, which protrude outside from the radiating pipe 11. Power for operating the control unit 20 is supplied to the control unit 20 through a power supply plus 21, which extends from the control unit 20.

Here, basic temperature values for controlling the temperature of the heating pipe 10 are input into the control unit 20. In detail, a low temperature value for rapidly increasing the temperature of the liquid heating medium 14 by supplying electricity to the all heating wires 12 when heating is started, a high temperature value for approaching the boiling point of the liquid heating medium 14, and an intermediate temperature value between the high temperature and the low temperature are selected. Such basic temperature values are input into the control unit 20, so that, every time the temperature of the liquid heating medium 14 reaches the low temperature and the intermediate temperature, electricity, which has been supplied to the heating wires 12, is interrupted one wire at a time. Furthermore, when the temperature of the liquid heating medium 14 reaches the high temperature or the preset temperature, electricity supply to the all heating wires 12 is interrupted.

For example, in the case that water is used as the liquid heating medium 14, it is preferable that the low temperature be set within a range from 40° C. to 60° C., the intermediate temperature be set within a range from 60° C. to 70° C., and the high temperature be set within a range from 76° C. to 80° C.

In installation of the heating apparatus 30 having the above-mention construction, the heating pipe 10 is embedded in the floor or other surface desired to be heated, and the control unit 20 is placed outside the floor. The operation of the heating apparatus 30 will be explained herein below. Power is supplied to the control unit, and a desired temperature value for heating is input into the control unit. If the temperature of the liquid heating medium 14 detected by the temperature sensor 161 is lower than the preset temperature, electricity is supplied to the all heating wires 12 to rapidly increase the temperature of the liquid heating medium 14. When the temperature of the liquid heating medium 14 reaches the low temperature value and the intermediate temperature value, electricity supply to the heating wires 12 is interrupted one by one. When the temperature of the liquid heating medium 14 reaches the high temperature, electricity supply to all heating wires 12 is interrupted. Here, if the detected temperature of the liquid heat medium 14 reaches the preset temperature, electricity is interrupted from the all heating wires 12. If the temperature of the liquid heating medium 14 again decreases lower than the preset temperature, electricity is supplied to the heating wires 12, thus maintaining the liquid heating medium 14 at the preset temperature.

Hereinafter, a safety means 10, which serves to prevent the heating pipe 10 from being damaged, will be explained herein below with reference to FIG. 10. As shown in the drawing, the safety means 10 includes a connection pipe 41, coupling nuts 42, packings 42', a cover 43 and an elastic ball 44. The connection pipe 41 is a T-shaped pipe. A thread (not shown) is formed on each end of the connection pipe 41. The coupling nuts 42 and the packings 42*a* have the same structures as those of typical coupling nut and packing, which is connected to a pipe to prevent water from leaking out. The cover 43 is coupled to an end of the connection pipe 41 to seal it. The elastic ball 44 is made of rubber or synthetic resin having superior heat resistance and elasticity. The elastic ball 44 has air of low density therein.

The structure and operation of the safety means 40 will be described herein below. The end of the radiating pipe 11 is cut and divided into two parts. The opposite ends of the connection pipe 41 are coupled to the facing ends of the two parts of the radiating pipe 11 using the coupling nuts 42 and the packings 42'. The elastic ball 44 is inserted into the remaining end of the connection pipe 41. Thereafter, the cover 43 is coupled to the end of the connection pipe 41 in which the elastic ball 44 is inserted, thus completing the safety means 40, which is reliably sealed. The safety means 40 having the above-mentioned structure compensates for the expansion of the liquid heating medium 14 due to an increased temperature by contraction of the elastic ball 44, thus preventing the radiating pipe 11 from being damaged, and preventing the liquid heating medium 14 from leaking.

In the heating apparatus of the present invention having the above-mentioned construction, when heating is started, the temperature of a desired portion can be rapidly increased by the three or more strands of heating wires, so that a rapid heating effect can be realized. Furthermore, because the heating wires are independently controlled, that is, because electricity can be independently supplied to and interrupted from each heating wire, the present invention can be effectively used for businesses or used in a greenhouse, or a severely cold area. In other words, the present invention can easily control the temperature of the desired place in any surroundings. In addition, the present invention has a simple structure, so that installation thereof is simple, and use thereof is convenient. As well, the present invention can be used in a new building in addition to being installed in an existing building, that is, with an existing heating system including a boiler and a radiating pipe, which is embedded in a desired place to circulate hot water for heating the desired place. Here, to apply the present invention to the existing heating system, the opposite ends of the existing radiating pipe are cut and, thereafter, heating wires are placed through the radiating pipe. Subsequently, the radiating pipe is charged with water, and the opposite ends of the radiating pipe are sealed by the connectors of the present invention. Thereafter, the control unit is connected to the heating wires, thus completing the installation of the heating apparatus. As such, the present invention has an advantage in that installation space is markedly reduced because a separate boiler and an oil reservoir are not required.

Although the preferred embodiment of the present invention has been disclosed for illustrative purposes, the scope of the present invention must be defined by the accompanying claims but not by the preferred embodiment. Furthermore, those skilled in the art will appreciate that various modifications, additions and substitutions are possible, without departing from the scope and spirit of the invention as disclosed in the accompanying claims.

INDUSTRIAL APPLICABILITY

As described above, in a connector and a heating apparatus having the connector according to the present invention, first and second conductive members are made of conductive material, while body parts including the first and second conductive members are made of dielectric material. Therefore, heating wires and electric wires are securely separated from each other, thus preventing shorts from occurring. Furthermore, a tapered part, which has a predetermined length and is increased in its inner diameter from a medial portion to an end, is formed on the circumferential inner surface of a coupling nut. Thus, when the coupling nut is fitted over the circumferential outer surface of a radiating pipe and a socket unit, having a tapered body, is fitted into the radiating pipe, the radiating pipe is reliably sealed by the inclined surfaces defined by the tapered parts.

In addition, in the present invention, the radiating pipe, through which the three strands of heating wires pass such that they extend outside the radiating pipe, is charged with liquid heating medium and is sealed, thus constructing a heating pipe. The heating pipe is connected to a control unit, thus constructing the heating apparatus. Electricity is supplied to all heating wires under the control of the control unit, so that the temperature of the liquid heating medium can be rapidly increased at an initial stage. That is, a rapid heating effect is ensured. As well, the heating apparatus of the present invention is simple, compared to that of the conventional art, so that installation thereof is simplified, and use thereof is convenient.

Moreover, the present invention includes a safety means, which is provided on each end of the heating pipe. To realize the safety means, each end of the radiating pipe is cut into two parts, and opposite ends of a T-shaped connection pipe coupled to facing ends of the two cut parts of the radiating pipe. An elastic ball is inserted into the remaining end of the connection pipe. Thereafter, a cover is coupled to the end of the connection pipe in which the elastic ball is inserted, thus completing the safety means. Thus, when the liquid heating medium is boiled or freezes so that the volume thereof is increased, the elastic ball is contracted, thus preventing the radiating pipe from being damaged, and preventing the liquid heating medium from leaking.

The invention claimed is:

1. A connector for heating apparatuses, comprising:

a plug unit (110), comprising a plurality of first conductive members (112), each of which has a predetermined shape and is connected to an electric wire (113), and a plug body part (111), in which the first conductive members (112) are integrally inserted;

a socket unit (120), comprising a socket body part (121) having a plurality of through holes (121*a*) therein, and a plurality of second conductive members (122) provided in the socket body part (121);

a coupling nut (130), with a seating hole (131), having a predetermined depth, formed in the coupling nut (130), an internal thread (131*a*) formed on a circumferential inner surface of the seating hole (131), and a through hole (132) formed through a central portion of a bottom of the coupling nut (130); and a coupling screw (140), with an insertion hole (141) longitudinally formed through a central portion of the coupling screw (140), and an external thread (142) formed on a circumferential outer surface of an end of the coupling screw (140).

2. The connector for heating apparatuses according to claim 1, wherein the plug body part (111) of the plug unit (110) comprise a plurality of protrusions (111*a*), each of which has a cross-section reduced in width from a proximal end thereof to a distal end thereof, and the socket unit (120) comprises a plurality of seating depressions (121*c*) corresponding to the respective protrusions (111*a*).

3. The connector for hearting apparatuses according to claim 2, wherein internal thread holes (121*b*), each having a predetermined depth, are formed at predetermined positions in the socket body part (121) of the socket unit (120), through holes (122*a*) and (122*b*) are formed in each of the second conductive members (122), and a guide groove (122*c*) is formed between the through holes (122*a*) and (122*b*) in the second conductive member (122).

4. The connector for heating apparatuses according to claim 1, wherein sealing holes (121*d*), each of which has a predetermined depth and communicates with each of the through holes (121*a*), are formed in the socket unit (120), so that, after heating wires (12) are inserted into the respective sealing hole (121*d*), each of the sealing holes (121*d*) is charged with sealing agent (121*e*).

5. The connector for heating apparatuses according to claim 1, wherein the coupling screw (140) has on a circumferential inner surface thereof a tapered part (114*a*), which is increased in diameter from a medical portion of the coupling screw (140) to an end of the coupling screw (140).

6. The connector for heating apparatuses according to claim 1, wherein the plug body part (111) of the plug unit (110) and the socket body part (121) of the socket unit (120)

are made of dielectric synthetic resin, and the first and second conductive members (112) and (122) are made of conductive metal.

7. A heating apparatus using a heating pipe, through which heating wires are provided, comprising:

the heating pipe (10), comprising a radiating pipe (11) made of a heat conductive pipe, the three to five strands of heating wires (12) provided through the radiating pipe (11), each of the heating wires (12) having a heating wire core (12*a*) and a covering (12*b*) surrounding an outer surface of the heating wire core (12*a*), liquid heating medium (14) charged into the radiating pipe (11), a temperature sensing wire (160) connected to a temperature sensor (161) to detect a temperature of the liquid heating medium, and a connector (100) closing each of opposite ends of the radiating pipe (11);

a control unit (20) to control supply and interruption of electricity using a temperature signal transmittal from the temperature sensor (161); and safety means (40) comprising a T-shaped connection pipe (41) provided at a predetermined position in the radiating pipe, with an elastic ball (44) provided in the connection pipe (41) having a thread on each of opposite ends thereof, so that contraction of the elastic ball (44) prevents the radiating pipe (11) from bursting.

8. The heating apparatus according to claim 7, wherein the connector (100) comprises:

a plug unit (110), comprising a plug body part (111), in which a plurality of first conductive members (112), each of which has a predetermined shape and is connected to an electric wire (113), is provided, a socket unit (120), comprising a socket body part (121) having a plurality of through holes (121*a*) therein, and a plurality of second conductive members (122) provided in the socket body part (121), a coupling nut (130), with a seating hole (131), having a predetermined depth, formed in the coupling nut (130), an internal thread (131*a*) formed on a circumferential inner surface of the seating hole (131), and a through hole (132) formed through a central portion of a bottom of the coupling nut (130); and a coupling screw (140), with an insertion hole (141) longitudinally formed through a central portion of the coupling screw (140), and an external thread (142) formed on a circumferential outer surface of an end of the coupling screw (140).

9. The connector for heating apparatuses according to claim 2, wherein the plug body part (111) of the plug unit (110) and the socket body part (121) of the socket unit (120) are made of dielectric synthetic resin, and the first and second conductive members (112) and (122) are made of conductive metal.

10. The connector for heating apparatuses according to claim 3, wherein the plug body part (111) of the plug unit (110) and the socket body part (121) of the socket unit (120) are made of dielectric synthetic resin, and the first and second conductive members (112) and (122) are made of conductive metal.

11. The connector for heating apparatuses according to claim 4, wherein the plug body part (111) of the plug unit (110) and the socket body part (121) of the socket unit (120) are made of dielectric synthetic resin, and the first and second conductive members (112) and (122) are made of conductive metal.

12. The connector for heating apparatuses according to claim 5, wherein the plug body part (111) of the plug unit (110) and the socket body part (121) of the socket unit (120) are made of dielectric synthetic resin, and the first and second conductive members (112) and (122) are made of conductive metal.

* * * * *